US008672521B1

(12) United States Patent
Huspen

(10) Patent No.: US 8,672,521 B1
(45) Date of Patent: Mar. 18, 2014

(54) DIGITIZED PHOTOGRAPH IN TRANSLUCENT MEDIUM

(76) Inventor: Michael F. Huspen, Berrien Springs, MI (US)

( * ) Notice: Subject to any disclaimer, the term of this patent is extended or adjusted under 35 U.S.C. 154(b) by 275 days.

(21) Appl. No.: 13/160,814

(22) Filed: Jun. 15, 2011

Related U.S. Application Data

(60) Provisional application No. 61/397,826, filed on Jun. 17, 2010.

(51) Int. Cl.
*F21V 3/02* (2006.01)

(52) U.S. Cl.
USPC ..... 362/311.01; 362/351; 362/360; 362/97.1

(58) Field of Classification Search
USPC ..... 362/605, 311.01, 311.13, 351, 355, 362/360, 97.1, 311.06
See application file for complete search history.

(56) References Cited

U.S. PATENT DOCUMENTS

| | | | | |
|---|---|---|---|---|
| 4,420,174 | A * | 12/1983 | Phelps et al. | 283/75 |
| 7,631,996 | B2 * | 12/2009 | Huang | 362/518 |
| 2004/0141325 | A1 * | 7/2004 | Davenport | 362/351 |
| 2007/0289180 | A1 * | 12/2007 | Johnson | 40/546 |
| 2010/0085743 | A1 * | 4/2010 | Franklin | 362/183 |

* cited by examiner

*Primary Examiner* — Bao Q Truong
(74) *Attorney, Agent, or Firm* — Botkin & Hall, LLP

(57) ABSTRACT

An image display and a method of making the same. The image display has a translucent medium that has a maximum thickness and at least one area of thinner thickness than the maximum thickness that is used to depict an image. To assist in viewing the image, a light is placed behind a translucent panel, from which the image is made, to provide a more defined image than would be viewable without backlighting. The translucent panel is monolithic and homogeneous. The method of making the image is performed by first digitizing a photograph of the image. After the image is digitized, it is processed by a CNC machine that converts the image into depth. The lighted display is particularly useful as a grave monument marker when the light source is connected to a solar cell that charges a battery so the display is lighted at night.

2 Claims, 3 Drawing Sheets

FIG. 3
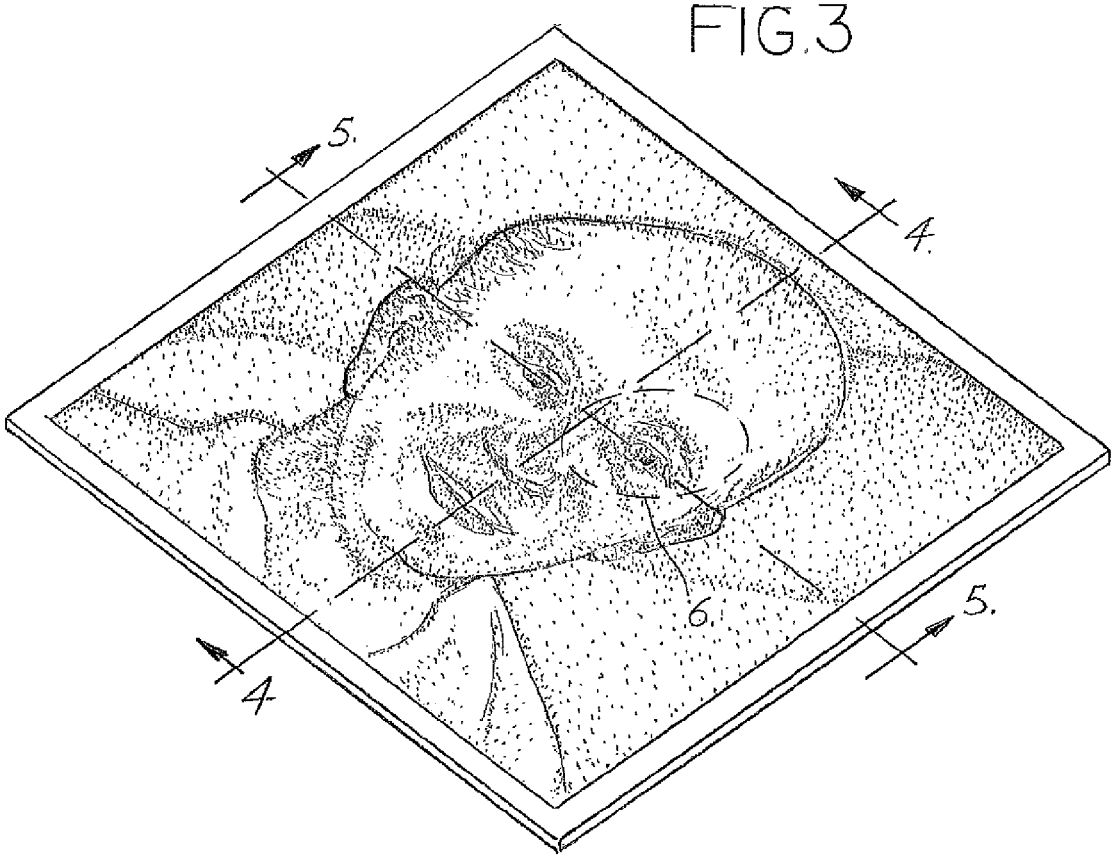
FIG. 4
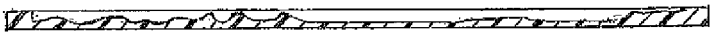
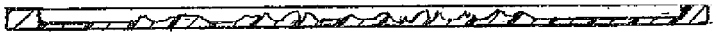
FIG. 5

FIG.6
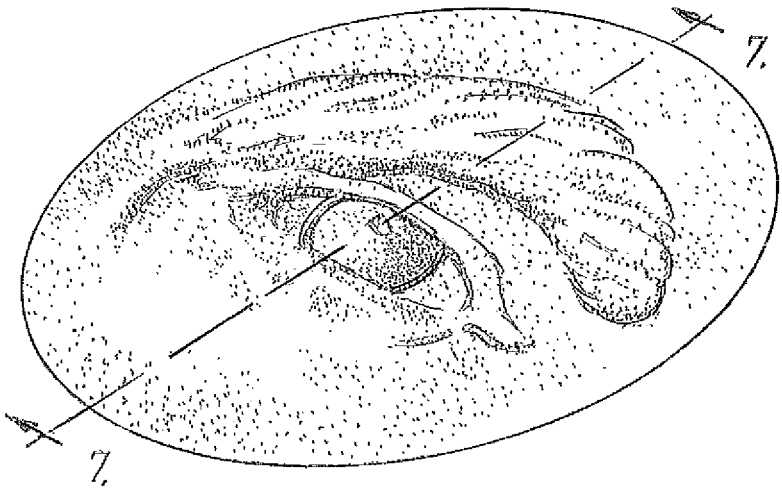
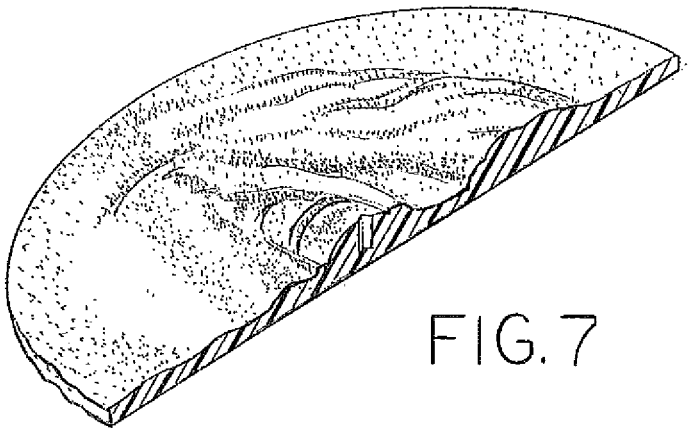
FIG.7

DIGITIZED PHOTOGRAPH IN TRANSLUCENT MEDIUM

CROSS REFERENCE TO RELATED APPLICATIONS

This application claims the benefit of U.S. Provisional Application No. 61/397,826, filed Jun. 17, 2010, the disclosure of which is hereby incorporated by reference.

BACKGROUND OF THE INVENTION

Grave monuments traditionally have changed very little for centuries. They are typically stone carvings with the names of decedents etched into the stone face. More modern monuments provide additional tributes to the decedent such as etchings of things other than the name of the person carved into the stone. Artwork such as a decedent's hobbies or their likeness may be etched into the stone. However, no matter how skillful the artwork, it is still not visible at night because external lighting in front of a monument stone is not typically available. A more complete tribute to the decedent would include a display with internalized lighting that would provide a lighted image of the decedent.

SUMMARY OF THE INVENTION

The present invention is an image display and a method of making the same. The image display has a translucent medium that has a maximum thickness and at least one area of thinner thickness than the maximum thickness used to depict an image. To assist in viewing the image, a light may be placed behind a translucent panel, from which the image is made, to provide a more defined image than would be viewable without backlighting. The translucent medium from which the image is made is monolithic and homogeneous.

The method of making the image is performed by first digitizing a photograph of the image. After the image is digitized, it is processed by a CNC machine that converts the image into depth of material to be machined from a blank.

BRIEF DESCRIPTION OF THE DRAWINGS

FIG. 3 is a perspective view of the translucent medium panel shown in FIGS. 1 and 2;

FIG. 4 is a sectional view taken about line 4-4 in FIG. 3;

FIG. 5 is a sectional view taken about line 5-5 in FIG. 3;

FIG. 6 is a perspective view of area 6 in FIG. 3; and

FIG. 7 is a sectional view taken about line 7-7 in FIG. 6.

DETAILED DESCRIPTION OF INVENTION

Figure 1:
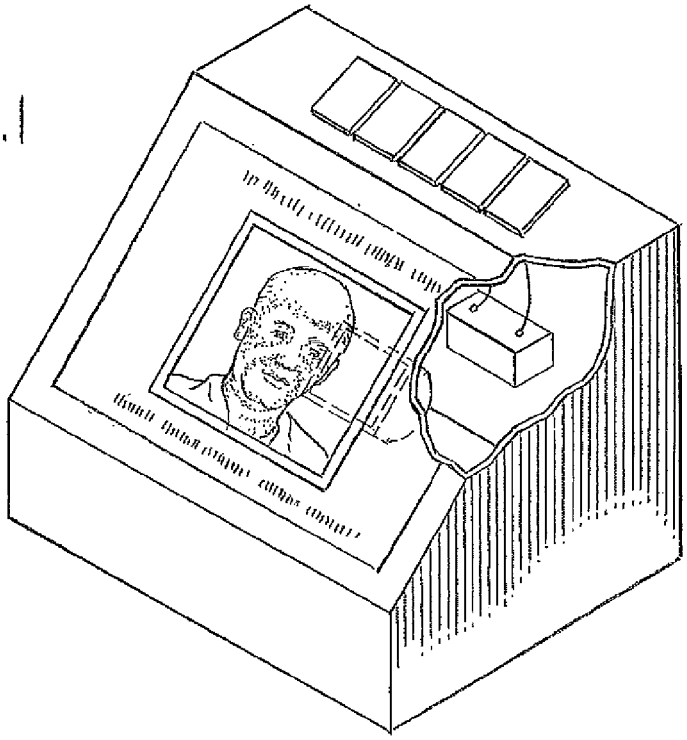
FIG. 1 is a perspective view of the display showing the image in translucent medium.
Figure 2:
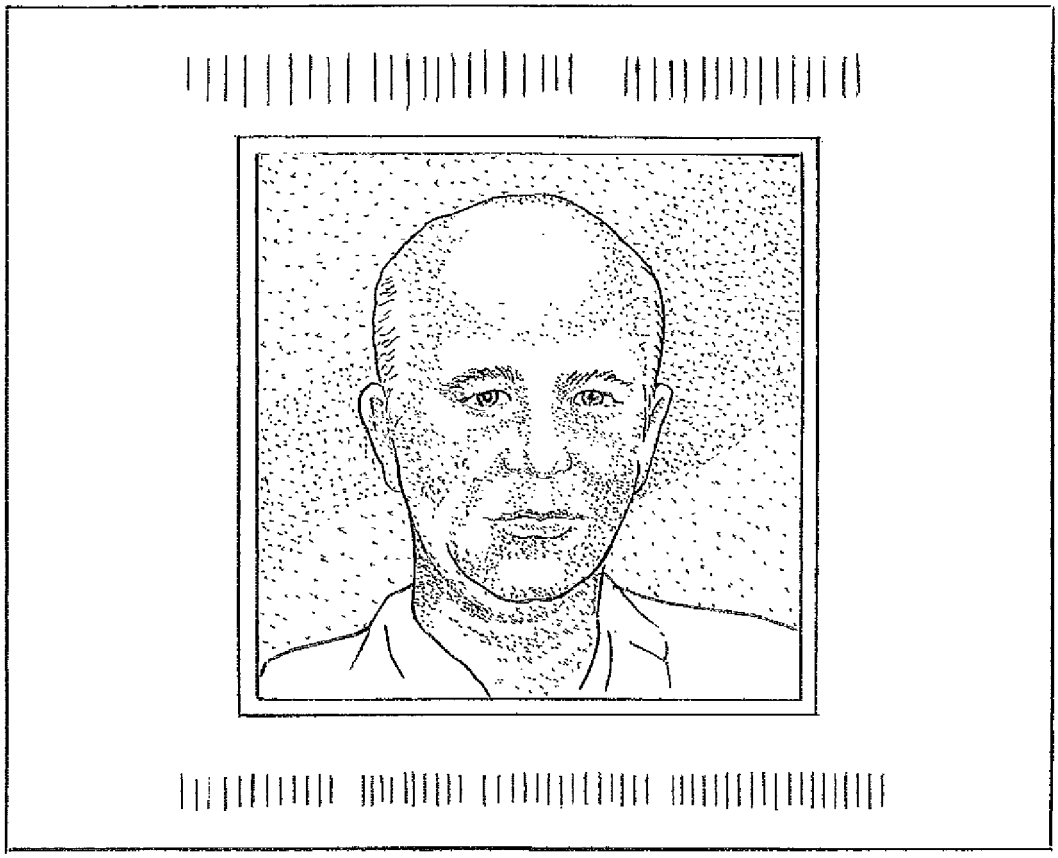
FIG. 2 is a view of the image shown in FIG. 1

The present invention is an image display 10 and method for producing the same. The display 10 may be used for grave monuments and has other applications as well. FIG. 1 shows the display 10 as it would be used on a grave monument. A cabinet 12 has an angled front face 14 that displays a translucent medium panel 16. The cabinet 12 may be mounted on a stone or concrete base and is raised above a ground surface to show the image 18 that is in the translucent panel 16. The cabinet 12 is made of stainless steel for the application of a grave monument so that corrosion will not be an issue due to exposure to the elements. The translucent panel 16 is made of a polymer that has an alabaster appearance in the case of a grave monument. The translucent panel 16 can also be made of a colored polymer other than white. The panel 16 is monolithic and homogeneous throughout its thickness. As can be seen in FIG. 1, the cabinet 12 contains a light 20 that is connected to a battery 22. The light 20 may be any bulb sufficient to produce a bright light that will illuminate the panel 16 and could also be an LED or other light-producing device. The battery 22 is connected to the light 20 with a light sensing switch 24 that has a sensor within it. The switch 24 closes its circuit in dark environments, particularly when nightfall has arrived and there is an absence of daylight. The switch 24 is open when light, such as sunlight, strikes it. The battery 22 is charged with a solar cell 28 connected to the battery. The solar cell 28 delivers sufficient power during daylight hours to charge the battery 22 to power the light 20 throughout multiple nights, in case there are multiple cloudy days that deny enough light to the solar cell 28 to properly charge the battery 22.

The translucent panel 16 is mounted within the cabinet 12 in a watertight manner to prevent water from entering the cabinet 12. Additionally, a glass panel being made of a silica glass or polymer such as polycarbonate may be placed over the translucent panel. The glass panel is not shown in the FIGS.

The translucent panel 16 has a rough side 30 and a smooth side 32. The glass panel serves as a barrier preventing debris from getting trapped on the rough surface of the translucent panel 16 facing outward. The rough side 30 of the translucent panel is typically chosen to face outward because the contrast of the image 18 will be more evident, however, the image can still be seen if the smooth side 32 of the translucent panel 16 is placed outward.

The translucent panel 16 is made by machining away material on the rough side 30, which initially starts out as smooth. All machining to the translucent panel 16 is done on the rough side 30. Before machining, the panel 16 is smooth on both sides 30, 32 and of uniform thickness. The thickness of the panel before machining starts out as uniform over the entire panel 16. The initial thickness of the panel 16 before machining is the maximum thickness. The maximum thickness of the panel 16 is shown in FIG. 3 as the border area 36, which remains unmachined on both sides 30, 32.

The image 18 is produced by variation in creating areas that appear light and dark when the panel 16 is illuminated opposite the side 30, 32 on which it is viewed. The image 18 machined into the translucent panel 16 is typically taken from a photograph. A photograph is taken, scanned into a digital file, or digitized, then stored in a computer. The computer is a CNC machine that processes the digital file and translates the file into different depths to machine in different areas of the rough side 30 of the panel 16. Dark areas of the digitized photograph correspond to less material being machined from the rough or machined side 30. Light areas require more material to be removed from the rough side 30 and may leave only several thousandths of an inch of material. As an example, a black area of a photograph, such as a pupil of a person's eye, would remain unmachined so that it remains as dark as possible. Thicker areas of the image 18 in the panel 16 will be darker as less light will travel through the translucent panel 16. Thinner areas will allow more light through the panel 16 and will therefore appear lighter. FIG. 7 shows a sectional view of the area around a pupil 34 in the image 18. As can be seen in FIG. 7, the pupil 34 is higher so it appears as a darker area in the image.

The machining may be done by a ball end mill or other type of end mill that will produce a desired finish. Such choices of end mills will be known to those skilled in the art. Such persons will have sufficient knowledge to choose an end mill that will yield a desired finish. Generally, smaller ball end mills such as 1/16 inch will produce sufficient resolution on a 6×6 inch panel 16. A translucent panel 16 having a thickness of 1/4 inch will produce a sharply contrasting image 18. If darker areas are desired to be darker, a thicker panel than 1/4 inch may be used. In such a case where a thicker panel than 1/4 inch is used, light areas may still be as light by machining to a thinness comparable to that as used in a 1/4 inch thick panel 16, but the dark areas may be made much darker due to the increased thickness. Overall contrast may generally be increased by using thicker panels. For the application of grave monuments, a 1/4 inch panel provides a good contrast.

The present invention is not limited to the details given above, but may be modified within the scope of the following claims.

What is claimed is:

1. A method of reproducing an image contained in a photograph comprising the steps of:

digitizing said image in said photograph having light and dark areas;

providing a translucent monolithic medium;

processing the digitized image into specific depths to be machined into said translucent monolithic medium for specific areas; and machining light areas from said image into relatively thin areas on said translucent medium and machining dark areas to reproduce said image in said translucent medium.

2. The method of claim 1, further comprising the step of backlighting said translucent medium.

* * * * *